US009085187B2

(12) United States Patent
Suzuki

(10) Patent No.: US 9,085,187 B2
(45) Date of Patent: Jul. 21, 2015

(54) IMAGE RECORDING APPARATUS

(71) Applicant: SEIKO EPSON CORPORATION, Tokyo (JP)

(72) Inventor: Manabu Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/188,556

(22) Filed: Feb. 24, 2014

(65) Prior Publication Data

US 2014/0267519 A1 Sep. 18, 2014

(30) Foreign Application Priority Data

Mar. 18, 2013 (JP) ..... 2013-054689

(51) Int. Cl.

| | |
|---|---|
| ***B41J 2/01*** | (2006.01) |
| ***B41J 29/377*** | (2006.01) |
| ***B41J 11/00*** | (2006.01) |
| *G03G 15/00* | (2006.01) |

(52) U.S. Cl.
CPC ..... *B41J 29/377* (2013.01); *B41J 11/002* (2013.01)

(58) Field of Classification Search
CPC ..... B41J 11/02; B41J 11/04; B41J 13/076
USPC ..... 347/102; 399/159
See application file for complete search history.

(56) References Cited

U.S. PATENT DOCUMENTS 5,502,476 A 3/1996 Neal et al.
8,814,347 B2 * 8/2014 Sugaya et al. ..... 347/102

FOREIGN PATENT DOCUMENTS

JP 07-276621 10/1995
JP 11-221914 8/1999
JP 2009-226811 10/2009
JP 2012077736 A1 * 6/2012 ..... B41J 11/002

* cited by examiner

*Primary Examiner* — Jannelle M LeBron
*Assistant Examiner* — Jeremy Bishop
(74) *Attorney, Agent, or Firm* — Workman Nydegger

(57) ABSTRACT

An image recording apparatus includes: a rotating drum including a hollow cylinder around which a recording medium is guided while the rotating drum rotates; a discharge head that discharges liquid onto the recording medium guided around the outer surface of the rotating drum; and an air flow generator that generates an air flow that passes through the inside of the hollow cylinder of the rotating drum. The rotating drum further includes, in the hollow cylinder, a shaft member that has an axis identical to a rotation axis of the rotating drum and supporting members that are plate-shaped and that extend from the shaft member in the radial direction of the rotating drum and support the hollow cylinder, and the rotating drum rotates in a rotation direction about the shaft member. Each of the supporting members includes at least one air hole penetrating therethrough in the rotation direction.

10 Claims, 6 Drawing Sheets

IMAGE RECORDING APPARATUS

BACKGROUND

1. Technical Field

The present invention relates to an image recording apparatus which discharges liquid from a discharge head and records an image on a recording medium supported on an outer surface of a rotating drum. In particular, the invention relates to a technique for cooling the rotating drum.

2. Related Art

U.S. Pat. No. 5,502,476 describes a printer which discharges an ink from a print head onto an outer surface of a drum to record an image. The printer prints an image on a print medium by cooling and curing ink deposited on the drum by using the drum and transferring the ink to a print medium that forms a nip with the drum. Moreover, in order to effectively cool the ink by using the drum, the drum is cooled by air flow generated using a fan. Specifically, a fan facing the hollow portion of the drum in the axial direction of the drum generates an air flow that passes through the hollow portion of the drum in the axial direction, whereby the drum is cooled (FIG. 11).

There is an image recording apparatus which records an image on the recording medium by discharging liquid from a discharge head onto a recording medium which is guided around an outer surface of a cylindrical platen (a rotating drum). In such an image recording apparatus, when the rotating drum is heated by the heat source in the apparatus, the rotating drum thermally expands, which causes the gap between the rotating drum and the discharge head to vary, which in turn may cause the liquid to become misaligned on the recording medium. Thus, the technique of U.S. Pat. No. 5,502,476 is used to cool the rotating drum by using a fan.

However, in order to effectively cool the rotating drum by using a fan, it is required that a large amount of high-speed air flow generated by the fan passes through the hollow portion of the rotating drum to promote heat exchange between the air flow and the rotating drum. In contrast, in an image forming apparatus of U.S. Pat. No. 5,502,476, a plurality of arms are disposed radially from the rotation axis of the rotating drum in the hollow portion of the rotating drum to support an outer peripheral member (a rim) of the rotating drum. Therefore, when the rotating drum rotates in order to transport the recording medium, the arms also rotate. The rotation direction of the arms intersects (is substantially orthogonal to) the direction of the air flow, so that the rotating arms catch the air flow and stop the air flow from passing. Under these circumstances, it is not always easy to generate a large amount of high-speed air flow that is intended to pass through the hollow portion of the rotating drum and it can be difficult to efficiently cool the rotating drum.

SUMMARY

An advantage of some aspects of the invention is that, in an image recording apparatus which discharges liquid from a discharge head and records an image on a recording medium supported by an outer surface of a rotating drum, the rotating drum can be efficiently cooled.

An image recording apparatus according to an aspect of the invention includes: a rotating drum including a hollow cylinder around which a recording medium is guided while the rotating drum rotates; a discharge head, opposing an outer surface of the rotating drum, that discharges liquid onto the recording medium guided around the outer surface of the rotating drum; and an air flow generator that generates an air flow that passes through the inside of the hollow cylinder of the rotating drum. The rotating drum further includes, in the hollow cylinder, a shaft member that has an axis identical to a rotation axis of the rotating drum and supporting members that are plate-shaped and that extend from the shaft member in the radial direction of the rotating drum and support the hollow cylinder, and the rotating drum rotates in a rotation direction about the shaft member. Each of the supporting members includes at least one air hole penetrating therethrough in the rotation direction.

In an aspect of the invention (the image recording apparatus) configured in this manner, the rotating drum includes the hollow cylinder around which the recording medium is guided. The discharge head discharges liquid onto the recording medium which is guided around the outer surface of the rotating drum, whereby an image can be recorded on the recording medium. Moreover, an air flow generator that generates an air flow that passes through a hollow portion (a portion inside of the hollow cylinder) of the rotating drum is provided and the rotating drum is cooled by the air flow.

However, the rotating drum includes, in the hollow portion, shaft members that have an axis identical to the rotation axis of the rotating drum and supporting members that are plate-shaped, and that extend from the shaft member in the radial direction and support the hollow cylinder, and the rotating drum rotates in a rotation direction about the shaft member. Therefore, when the rotating drum rotates, the supporting members in the hollow portion also rotate in the rotation direction. In addition, the rotation direction of the supporting members is a direction intersecting (substantially orthogonal to) the direction of the air flow passing through the hollow portion, whereby the rotating supporting members may block the air flow.

In this respect, according to an aspect of the invention, the air holes penetrating through the supporting member in the rotation direction are disposed. Therefore, the air flow generated by the air flow generator passes through the air holes in the rotation direction, thereby avoiding being caught by the supporting members rotating in the rotation direction and is able to pass through the hollow portion. As a result, a large amount of the high-speed air flow can be generated and introduced into the hollow portion of the rotating drum, whereby the rotating drum can be efficiently cooled.

As mentioned above, heating of the rotating drum becomes a problem when the heated rotating drum thermally expands, the gap between the rotating drum and the discharge heads may vary. In particular, expansion of the outer surface of the rotating drum considerably affects the gap between the rotating drum and the discharge head. Therefore, it is important to efficiently cool the hollow cylinder of the rotating drum. In this respect, the image recording apparatus may be configured so that the supporting members include a fin portion that does not have an air hole and that has a width that extends from the inner surface of the hollow cylinder toward the shaft member in the radial direction. In such a configuration, while a large amount of the high-speed air flow is secured in the hollow portion by the air holes disposed in a region other than the fin portion, the air flow can sufficiently impinge on a portion of the supporting members which is close to the hollow cylinder (the fin portion). As a result, the hollow cylinder can exchange heat via the fin portion by using a large amount of the high-speed air flow, whereby the hollow cylinder can be efficiently cooled.

In this case, the image recording apparatus may be configured so that the width of the fin portion in the radial direction is equal to or larger than the width of the air hole in the radial direction. The fin portion has such a width, whereby the hollow cylinder can be efficiently reliably cooled.

From another viewpoint, the image recording apparatus may be configured so that the total area of the air holes disposed in a region of the supporting members which lies at a distance of r/2 or less from the rotation axis of the rotating drum in the radial direction is larger than the total area of the air holes disposed in a region of the supporting members which lies at a distance larger than r/2 from the rotation axis of the rotating drum, where the radius of the rotating drum is r. In such a configuration, more air holes are disposed in a region of the supporting members which is close to the center of the rotating drum, whereby the air flow does not pass through and is blown to the region of the supporting members which is close to the hollow cylinder. As a result, the hollow cylinder can exchange heat with a large amount of the high-speed air flow, whereby the hollow cylinder can be efficiently cooled.

In this respect, the image recording apparatus may be configured so that the plurality of the air holes are disposed in the radial direction between the inner surface of the hollow cylinder and the shaft member. Moreover, the image recording apparatus may be configured so that the plurality of air holes are disposed also in the axial direction. Because the plurality of air holes are disposed in this manner, the supporting members can effectively suppress blocking of the air flow, so that a large amount of the high-speed air flow can be generated in the hollow portion of the rotating drum, whereby cooling efficiency of the rotating drum can be improved.

In this respect, the image recording apparatus may be configured so that, from the above mentioned viewpoint in which the hollow cylinder of the rotating drum is efficiently cooled, the auxiliary heat dissipation member is also disposed on the inner surface of the hollow cylinder of the rotating drum in addition to the supporting members. In such a configuration, the air flow can sufficiently impinge on the auxiliary heat dissipation member disposed on the hollow cylinder, so that the hollow cylinder can exchange heat via the auxiliary heat dissipation member with a large amount of the high-speed air flow, whereby the hollow cylinder can be efficiently cooled.

Then, the image recording apparatus may be configured so that the auxiliary heat dissipation member is formed in the shape of a ring that extends over the entire periphery in the peripheral direction on the inner surface of the hollow cylinder. The auxiliary heat dissipation member is disposed in this manner to be able to promote heat exchange between the air flow and the hollow cylinder via the auxiliary heat dissipation member, whereby the hollow cylinder can be efficiently reliably cooled.

Then, the image recording apparatus may be configured so that the auxiliary heat dissipation member includes a wall surface that is inclined in the direction of the air flow and is disposed on an upstream side in the air flow direction. In such a configuration, because the wall surface is inclined in the direction of the air flow which the auxiliary heat dissipation member includes on an upstream side in the air flow direction, the wall surface of the auxiliary heat dissipation member can suppress blocking of the air flow.

Moreover, the image recording apparatus may be configured so that the discharge head further includes a light irradiator that irradiates a liquid having been discharged onto the recording medium with light, the liquid is a photo-curable liquid which generates heat when it is cured by irradiation with light, and the light irradiator irradiates a portion of the recording medium that is guided around the rotating drum with light. In such an image recording apparatus, the heat generated when the photo-curable liquid is cured heats the rotating drum, resulting in variation of the gap between the rotating drum and the discharge head. In this case, the apparatus has the above-mentioned configuration according to an aspect of the invention, so that a large amount of the high-speed air flow is generated in the hollow portion of the rotating drum, whereby the cooling efficiency of the rotating drum can be preferably improved.

In particular, if the light irradiator irradiates a portion of the recording medium that is guided around the rotating drum with light, heat is generated when the photo-curable liquid is cured. The heat heats the rotating drum, thereby causing the gap between the rotating drum and the discharge head to vary, which becomes a serious problem. In this case, the apparatus has the above-mentioned configuration according to an aspect of the invention, so that cooling efficiency of the rotating drum can be highly preferably improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
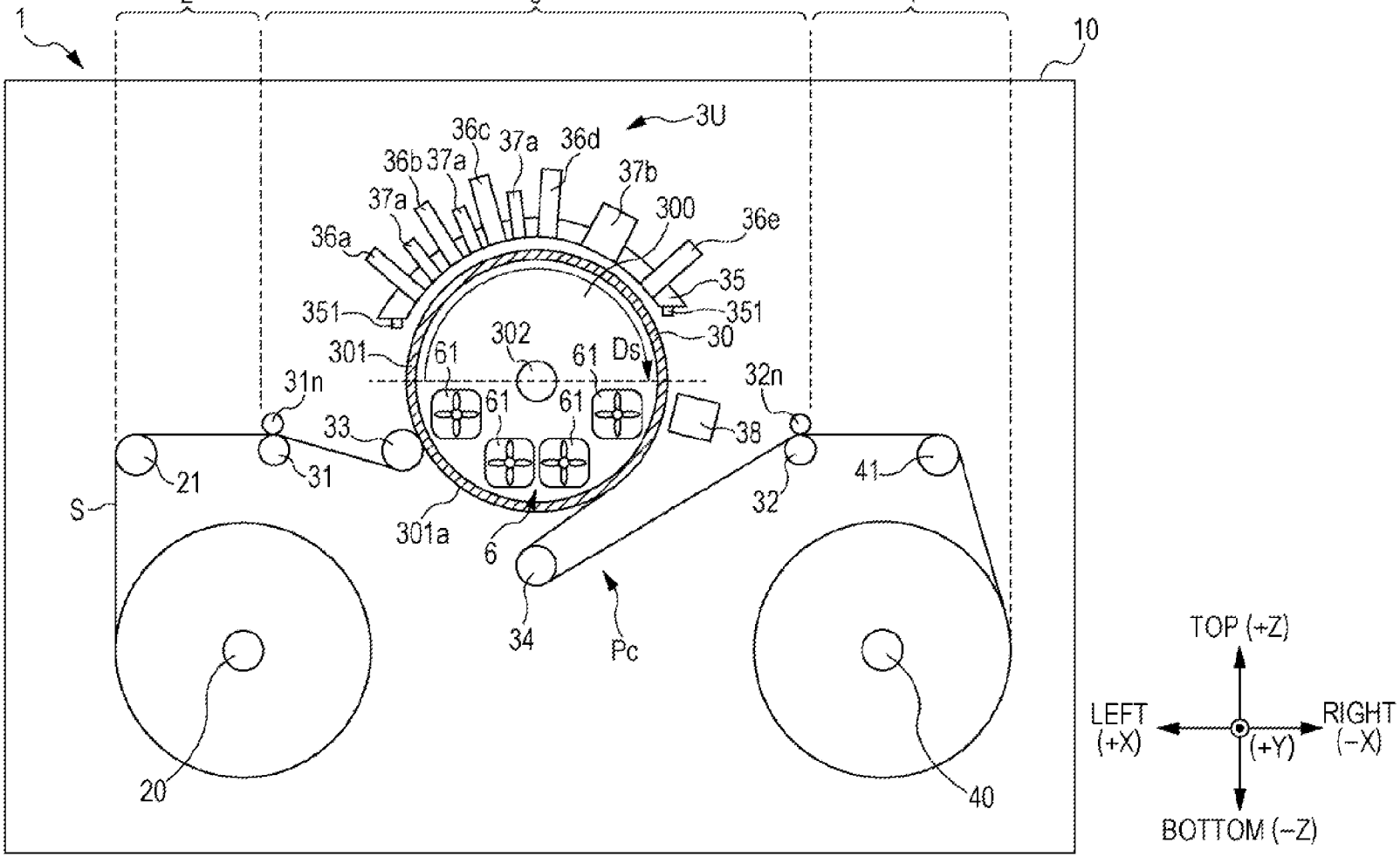
FIG. 1 is a front view schematically illustrating a schematic configuration of a printing apparatus to which the invention is applicable.

FIG. 1 is a front view schematically illustrating a schematic configuration of a printing apparatus to which the invention is applicable. An XYZ orthogonal coordinate system corresponding to a left-right direction X, a front-rear direction Y, and a vertical direction Z of a printing apparatus 1 is shown in FIG. 1 and other figures as necessary for clarity of the positional relationships between various components of the apparatus.

The printing apparatus 1 includes a feeding section 2, a processing section 3, and a winding section 4 arranged in the left-right direction X. These functional portions 2, 3, and 4 are accommodated in a housing member 10 (a casing). The feeding section 2 and the winding section 4 include a feeding shaft 20 and a winding shaft 40, respectively. A sheet S (a web) has both ends wrapped into rolls around the feeding shaft 20 and the winding shaft 40, respectively, and is stretched between the feeding shaft 20 and the winding shaft 40. The sheet S stretched in this manner is transported along a path Pc from the feeding shaft 20 to the processing section 3. In the processing section 3, a processing unit 3U performs recording on the sheet S and subsequently the sheet S is transported to the winding shaft 40. The sheet S may be either a paper sheet or a film sheet. Specifically, examples of the paper sheet include bond paper, cast paper, art paper, coated paper, and the like while examples of the film sheet include synthetic paper, PET (polyethylene terephthalate), PP (polypropylene), and the like. In the following description, one surface of the sheet S on which an image is recorded is referred to as a front side while another surface is referred to as a back side.

The feeding section 2 includes the feeding shaft 20 around which the end of the sheet S is wrapped, and a driven roller 21 around which the sheet S having been drawn from the feeding shaft 20 is guided. The feeding shaft 20 supports the sheet S by wrapping the end of the sheet S therearound in a state in which the front side of the sheet S faces outside. The feeding shaft 20 rotates clockwise in FIG. 1, whereby the sheet S wrapped around the feeding shaft 20 is fed via the driven roller 21 to the processing section 3. In this regard, the sheet S is wrapped around the feeding shaft 20 via a core tube (not shown) detachable from the feeding shaft 20. Therefore, when the sheet S around the feeding shaft 20 is exhausted, a new core tube around which a new sheet S is wrapped into a roll can be mounted on the feeding shaft 20.

The processing section 3 is intended to print an image on the sheet S by performing processing properly using the processing unit 3U disposed along the outer surface 301*a* of the rotating drum 30 while the rotating drum 30 supports the sheet S fed from the feeding section 2. In the processing section 3, each of a preceding drive roller 31 and a succeeding drive roller 32 are disposed on a corresponding one of both sides of the rotating drum 30. An image is printed on the sheet S which is transported from the preceding drive roller 31 to the succeeding drive roller 32 and supported by the rotating drum 30.

The preceding drive roller 31 includes a plurality of minute protrusions formed by thermal spraying on the outer surface and guides the sheet S fed from the feeding section 2 with the back side of the sheet S facing the preceding drive roller 31. The preceding drive roller 31 rotates clockwise in FIG. 1, whereby the sheet S fed from the feeding section 2 is transported downstream in the transport path. A nip roller 31*n* is disposed so as to oppose the preceding drive roller 31. The nip roller 31*n* abuts against the front side of the sheet S in a state in which the nip roller 31*n* is urged toward the preceding drive roller 31 and the sheet S is nipped between the nip roller 31*n* and the preceding drive roller 31. Thus, friction force between the preceding drive roller 31 and the sheet S is secured, so that the preceding drive roller 31 can reliably transport the sheet S.

The rotating drum 30 is a cylindrical drum having a center line parallel to the Y-direction. The rotating drum 30 includes a hollow portion 300 penetrating the rotating drum 30 in the axial direction Y, and the sheet S is guided around the outer surface 301*a* of a hollow cylinder 301 surrounding the hollow portion 300. Furthermore, the rotating drum 30 includes, in the hollow portion 300, a rotation shaft 302 extending in the axial direction, through which the center line of the cylindrical shape extends. The rotation shaft 302 is rotatably supported by a supporting device (not shown) and the rotating drum 30 rotates about the rotation shaft 302.

The sheet S transported from the preceding drive roller 30 to the succeeding drive roller 32 is guided around the outer surface 301*a* of the rotating drum 30 with the back side of the sheet S facing the preceding drive roller 31. The rotating drum 30 is driven to rotate in the transport direction Ds of the sheet S under friction force against the sheet S while supporting the sheet S from the back side. In this regard, in the processing section 3, each of driven rollers 33 and 34 for turning the sheet S back are disposed on a corresponding end portion of the sheet S that is guided on the rotating drum 30. The driven roller 33 directs the sheet S back between the preceding drive roller 31 and the rotating drum 30 with the front side of the sheet S facing the driven roller 33. On the other hand, the driven roller 34 directs the sheet S back between the rotating drum 30 and the succeeding drive roller 32 with the front side of the sheet S facing the driven roller 34. In this manner, the sheet S is directed back upstream and downstream of the rotating drum 30 in the transport direction Ds, whereby the length of the portion of the sheet S that is guided on the rotating drum 30 can be large.

The succeeding drive roller 32 includes a plurality of minute protrusions formed by thermal spraying on the outer surface and guides the sheet S transported from the rotating drum 30 via the driven roller 34 with the back side of the sheet S facing the succeeding drive roller 32. The succeeding drive roller 32 rotates clockwise in FIG. 1, whereby the sheet S is transported to the winding section 4. A nip roller 32*n* is disposed so as to oppose the succeeding drive roller 32. The nip roller 32*n* abuts against the front side of the sheet S in a state in which the nip roller 32*n* is urged toward the succeeding drive roller 32 and the sheet S is nipped between the nip roller 32*n* and the succeeding drive roller 32. Thus, friction force between the succeeding drive roller 32 and the sheet S is secured, so that the succeeding drive roller 32 can reliably transport the sheet S.

In this manner, the sheet S transported from the preceding drive roller 31 to the succeeding drive roller 32 is supported by the outer surface 301*a* of the rotating drum 30. Moreover, in the processing section 3, the processing unit 3U is disposed to print a color image on the front side of the sheet S support by the rotating drum 30. The processing unit 3U includes an arc-shaped unit supporting member 35 arranged along the outer surface 301*a* of the rotating drum 30, and the unit supporting member 35 supports print heads 36*a* to 36*e* and UV irradiators 37*a* and 37*b*.

Four print heads 36*a* to 36*d* arranged in sequence in the transport direction Ds correspond to yellow, cyan, magenta, and black and discharge the corresponding color inks from nozzles in the ink jet technique. The four print heads 36*a* to 36*d* extend radially from the rotation shaft 302 of the rotating drum 30 and are arranged along the outer surface 301*a* of the rotating drum 30. Each of the print heads 36*a* to 36*d* is positioned with respect to the rotating drum 30 using the unit supporting member 35, and opposes the rotating drum 30 with a slight clearance (a gap for rotation) from the rotating drum 30. Thus, each of the print heads 36*a* to 36*d* opposes the front side of the sheet S which is guided around the rotating drum 30 with a predetermined paper gap. When each of the print heads 36*a* to 36*d* discharges an ink in a state in which the unit supporting member 35 determines the paper gap, the ink is deposited on a desired position of the front side of the sheet S, whereby a color image is formed on the front side of the sheet S.

The ink used for the print heads 36*a* to 36*d* is a UV (ultraviolet) ink (a photo-curable ink) to be cured by irradiation with ultraviolet rays (light). The processing unit 3U is provided with UV irradiators 37*a* and 37*b* in order to cure and fix the ink on the sheet S. In this respect, the ink curing is performed in two stages, precuring and curing. Each of the UV irradiators 37*a* for precuring is disposed between two corresponding print heads in the four print heads 36*a* to 36*d*. That is, the UV irradiators 37*a* are intended to irradiate relatively weak ultraviolet rays to cure (precuring) the ink to such an extent that the shape of the ink does not change, and are not intended to completely cure the ink. On the other hand, the UV irradiator 37*b* for curing is disposed downstream of the four print heads 36*a* to 36*d* in the transport direction Ds. That is, the UV irradiators 37*b* are intended to irradiate ultraviolet rays stronger than the UV irradiators 37*a* to completely cure (curing) the ink. The precuring and the curing can be used to fix the color image formed by the plurality of print heads 36*a* to 36*d* on the front side of the sheet S.

Furthermore, a print head 36*e* is disposed downstream of the UV irradiator 37*b* in the transport direction Ds. The print head 36*e* discharges a transparent UV ink from a nozzle in the ink jet technique. The print head 36*e* is positioned with respect to the rotating drum 30 using the unit supporting member 35, and opposes the rotating drum 30 with a slight clearance (a platen gap) from the rotating drum 30. Thus, the print head 36*e* opposes the front side of the sheet S which is guided around the rotating drum 30 with a predetermined paper gap. When the print head 36*e* discharges an ink in a state in which the unit supporting member 35 determines the platen gap, the ink is deposited on a desired position of the front side of the sheet S, whereby a color image on the front side of the sheet S is covered with the transparent ink.

In this manner, the processing unit 3U is constituted by the print heads 36*a* to 36*e* and the UV irradiators 37*a* and 37*b* mounted on the unit supporting member 35. In this respect, The unit supporting member 35 extending in the X-direction bridges between two rails 351 extending in the Y-direction and freely moves on the rails 351 in the Y-direction along with the print heads 36*a* to 36*e* and the UV irradiators 37*a* and 37*b*. When printing is performed on the sheet S, the unit supporting member 35 is positioned in the print location Ta (FIG. 2) so as to oppose the rotating drum 30. On the other hand, when an operator performs maintenance of the print heads 36*a* to 36*e* and the UV irradiators 37*a* and 37*b*, the unit supporting member 35 is positioned in the work location Tc (FIG. 2) away from the rotating drum 30 in the Y-direction. Thus, an operator can perform maintenance for the print heads 36*a* to 36*e* and the UV irradiators 37*a* and 37*b* in the work location Tc away from the rotating drum 30. In this respect, to access the work location Tc, an operator opens a door (not shown) disposed on a rear side (−Y side) of the housing member 10.

Furthermore, in the processing section 3, the UV irradiator 38 is disposed downstream of the print head 36*e* in the transport direction Ds. The UV irradiator 38 is intended to irradiate strong ultraviolet rays to completely cure (curing) the transparent ink which the print head 36*e* discharges. Thus, the transparent ink covering the color image can be fixed on the front side of the sheet S.

The sheet S on which the color image has been formed by the processing section 3 is transported to the winding section 4 by the succeeding drive roller 32. In addition to the winding shaft 40 around which the end of the sheet S is wrapped, the winding section 4 includes a driven roller 41 around which the sheet S is guided, disposed between the winding shaft 40 and the succeeding drive roller 32 with the back side of the sheet S facing the driven roller 41. The winding shaft 40 supports the sheet S by winding the end of the sheet S therearound in a state in which the front side of the sheet S faces outward. That is, the winding shaft 40 rotates clockwise in FIG. 1, whereby the sheet S having been transported from the succeeding drive roller 32 via the driven roller 41 is wound around the winding shaft 40. In this regard, the sheet S is wound around the winding shaft 40 via a core tube (not shown) detachable from the winding shaft 40. Therefore, when the winding shaft 40 is wound to its maximum capacity of the wound sheet S, the sheet S can be removed together with the core tube.

Figure 2:
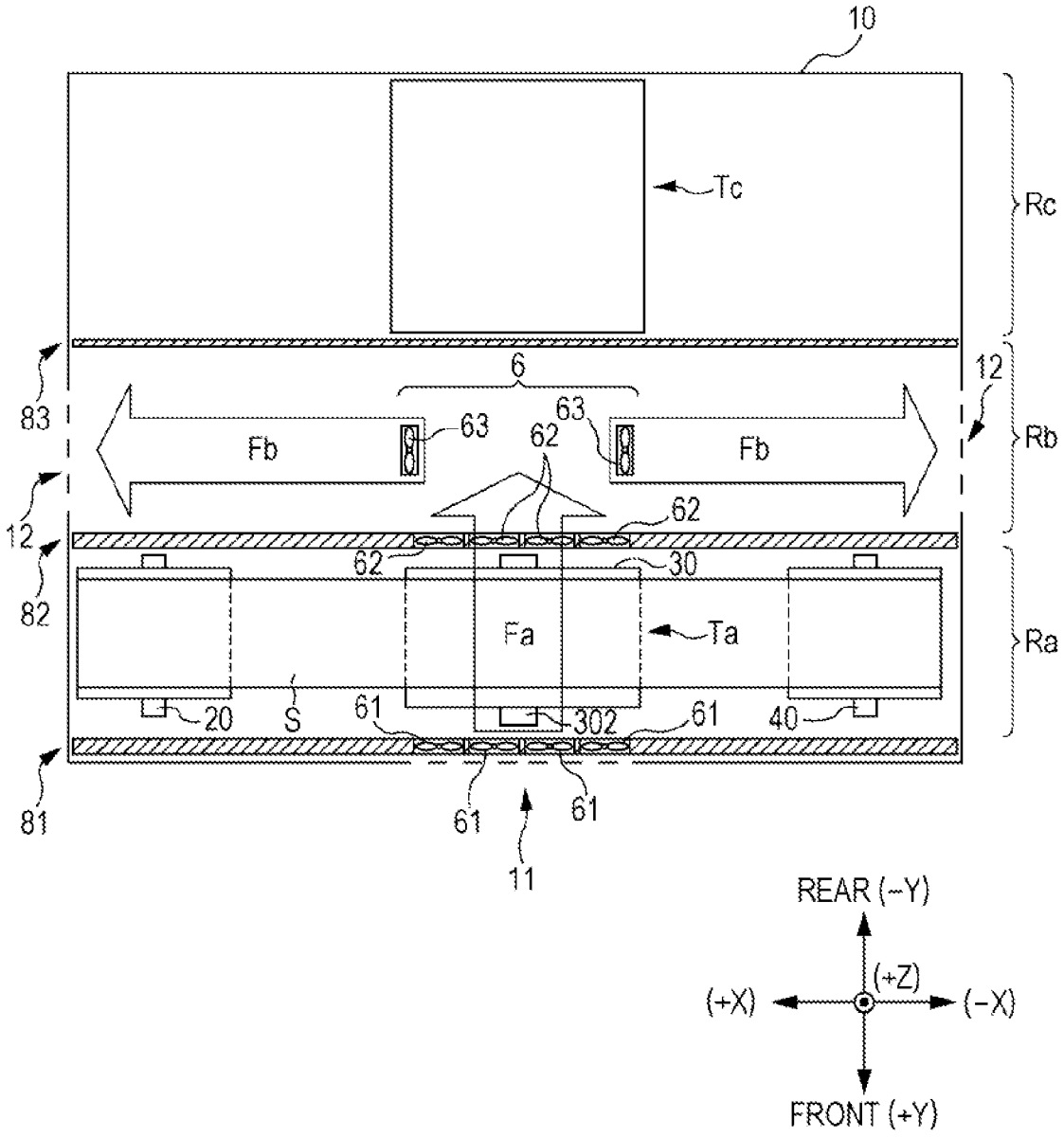
FIG. 2 is a plan view schematically illustrating the schematic configuration of the printing apparatus shown in FIG. 1.
Figure 3:
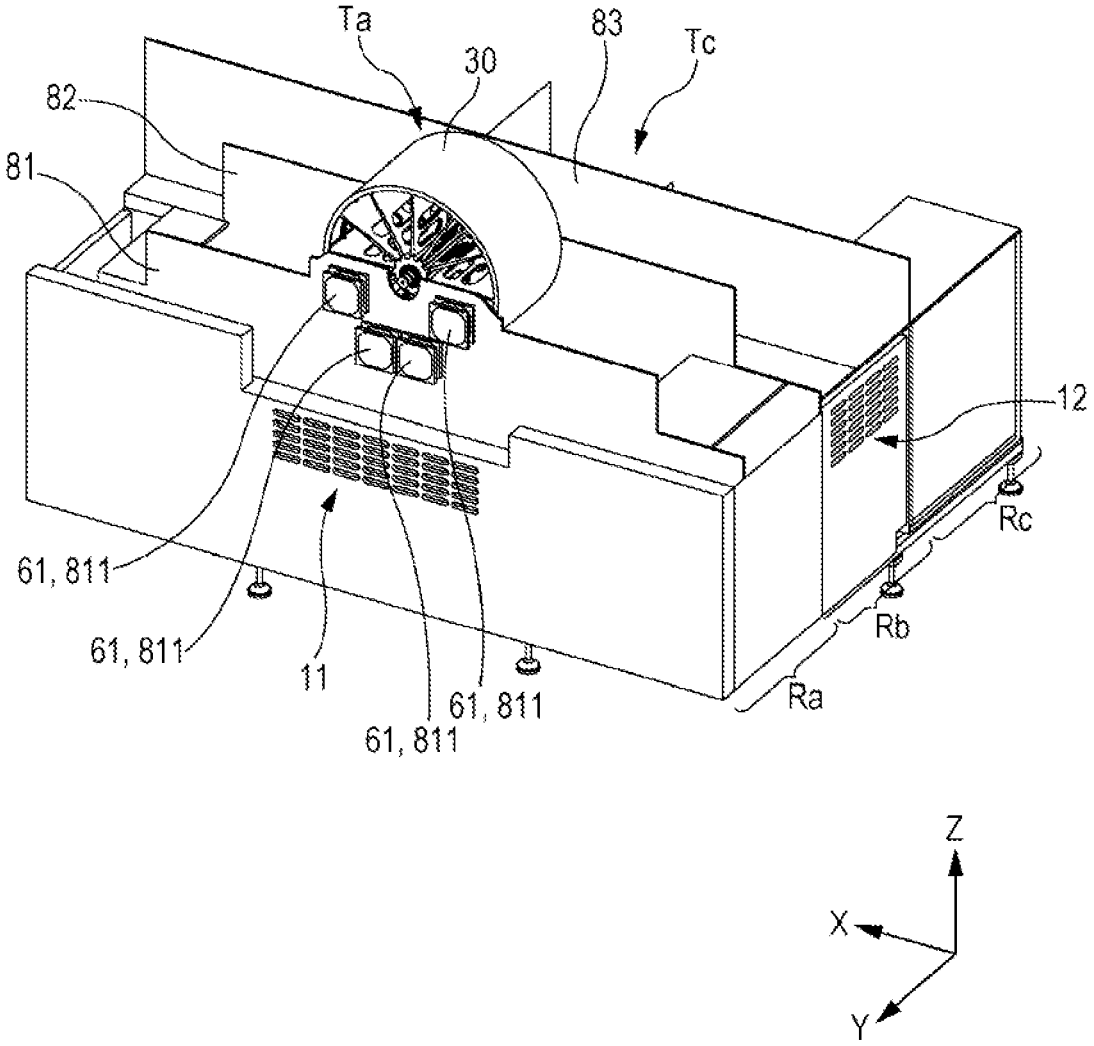
FIG. 3 is a front perspective view partially illustrating the schematic configuration of the printing apparatus shown in FIG. 1.
Figure 4:
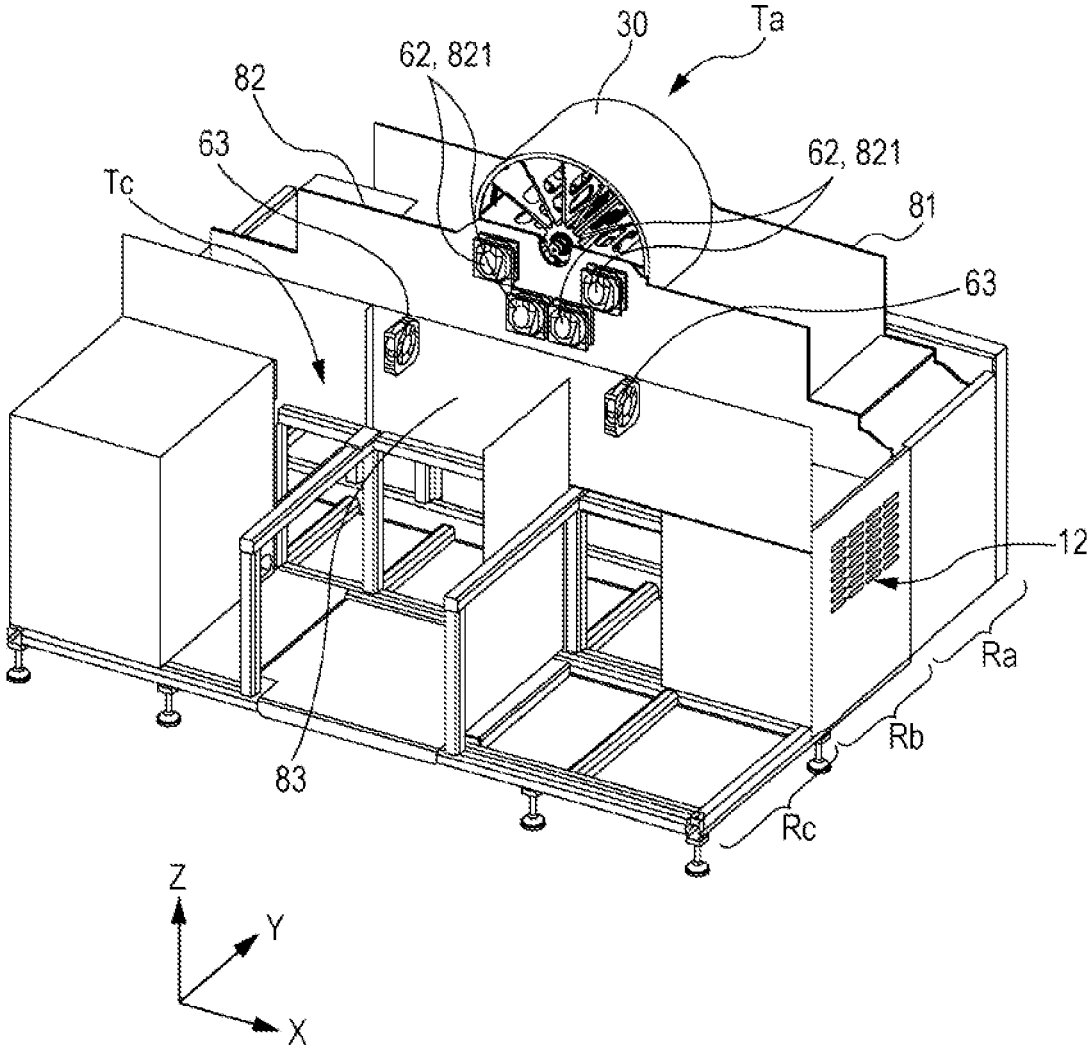
FIG. 4 is a rear perspective view partially illustrating the schematic configuration of the printing apparatus shown in FIG. 1.

A UV ink discharged from the print heads 36*a* to 36*e* generates heat when it is cured by irradiation with ultraviolet rays. Thus, the heat of the UV ink is transferred via the sheet S to the rotating drum 30, whereby the rotating drum 30 thermally expands. As a result, the gap (the platen gap) between the rotating drum 30 and the print heads 36*a* to 36*e* can vary. In particular as shown in FIG. 1, in the printing apparatus 1 in which the UV lamps 37*a*, 37*b*, and 38 irradiate a portion of the sheet S that is guided on the rotating drum 30 with ultraviolet rays, it may become a serious problem that the heat generated when the UV ink is cured heats the rotating drum 30, resulting in variation of the platen gap. Moreover, the rotating drum can be heated by heat generated by the UV lamps 37*a*, 37*b*, and 38 other than the heat from the UV ink. To this end, the printing apparatus 1 includes an air flow generating system which generates an air flow that passes through the hollow portion 300 of the rotating drum 30 for cooling the rotating drum 30. Referring to FIG. 2 to FIG. 4 in addition to FIG. 1, the air flow generating system will now be described mainly.

FIG. 2 is a plan view schematically illustrating the schematic configuration of the printing apparatus shown in FIG. 1. FIG. 3 is a front perspective view partially illustrating the schematic configuration of the printing apparatus shown in FIG. 1. FIG. 4 is a rear perspective view partially illustrating the schematic configuration of the printing apparatus shown in FIG. 1. FIG. 3 and FIG. 4 show an inner configuration of the printing apparatus 1 with an upper portion of the housing member 10 removed and details of the processing unit 3U, the sheet S, and the like omitted. FIG. 4 also shows an exhaust fan 63 when viewed through a frame member 83.

As apparent from FIG. 2, in the printing apparatus 1, a print region Ra in which an image is formed on the sheet S, a path region Rb which is adjacent to the print region Ra in the rear side (−Y side) in the Y-direction, and a work region Rc which is adjacent to the path region Rb in the rear side (−Y side) in the Y-direction are disposed. The air flow generating system 6 is intended to direct the air flow through the print region Ra in which the devices (the rotating drum 30 and the like) shown in FIG. 1 are arranged, in the Y-direction and to exhaust the air through the path region Rb. Specifically, the air flow generating system 6 includes four blower fans 61 disposed on the front side in the axial direction Y (+Y side) with respect to the rotating drum 30 and six exhaust fans 62 and 63 disposed on the rear side in the axial direction Y (−Y side) with respect to the rotating drum 30.

The four blower fans 61 are aligned in the X-direction and arranged below a horizontal virtual plane P30 which includes the center line of rotation (the center line of the cylindrical shape) of the rotating drum 30 (on the opposite side compared to the positions above the virtual plane P30 in which the print heads 36*a* to 36*e* are disposed). Each of the blower fans 61 is oriented in the axial direction Y of the rotating drum 30 and opposes the hollow portion 300. The housing member 10 includes a louver 11 opposing the hollow portion 300 formed in the front side in the axial direction Y (+Y side), and each of the blower fans 61 takes in air through the louver 11 from the outside of the apparatus 1 and directs the air into the hollow portion 300 of the rotating drum 30. The two blower fans 61 out of these four blower fans 61 closer to the center of the rotating drum 30 are disposed lower than the other two blower fans 61 farther away from the center of the rotating drum 30. In this manner, the four blower fans 61 are arranged depending on the shape of the hollow portion 300, thereby being able to blow air efficiently into the hollow portion 300.

The six exhaust fans 62 and 63 are also disposed below the horizontal virtual plane P30 which includes the center line of rotation. These exhaust fans 62 and 63 take in air through the hollow portion 300 of the rotating drum 30 and exhaust the air through the path region Rb to the outside of the apparatus 1. The four exhaust fans 62 out of the six exhaust fans 62 and 63 are disposed on the boundary of the print region Ra and the path region Rb with the four exhaust fans 62 being oriented away from the hollow portion 300 in the axial direction Y of the rotating drum 30. Therefore, each of the exhaust fans 62 takes in air from the hollow portion 300 and discharges the air into the path region Rb in the axial direction Y.

On the other hand, each of the two exhaust fans 63 is arranged so as to correspond to diametrically opposite ends of the hollow portion 300 in the horizontal direction X and so as to be oriented to the right and the left, respectively, in the horizontal direction X orthogonal to the axial direction Y of the rotating drum 30. Therefore, the exhaust fan 63 on the right side in the horizontal direction X (−X side) discharges air which has been taken in from the hollow portion 300 and has been discharged from the exhaust fan 62, along the path region Rb toward the right side in the horizontal direction X (−X side). The exhaust fan 63 on the left side in the horizontal direction X (+X side) discharges air which has been taken in from the hollow portion 300 of the rotating drum 30 and has been discharged from the exhaust fan 62, along the path region Rb toward the left side in the horizontal direction X (+X side). The housing member 10 includes a louver 12 at both ends of the path region Rb in the horizontal direction X, and air discharged from each of the exhaust fans 63 exits the apparatus 1 through the louver 12.

In this manner, the air flow generating system 6 including the blower fans 61 and the exhaust fans 62 and 63 is provided. Thus, in the inside of the printing apparatus 1, an air flow Fa is generated which passes through the hollow portion 300 of the rotating drum 30 in the axial direction Y and enters the path region Rb, and an air flow Fb which has passed from the rotating drum 30 into the path region Rb turns in the horizontal direction X and is exhausted. That is, air taken in from the outside of the apparatus 1 moves in the air flow Fa in the axial direction Y, and subsequently moves in the air flow Fb in the horizontal direction X and exits the apparatus 1. In this case, the exhaust fans 63 oriented in the horizontal direction X are disposed ahead of the air flow Fa, so that the air flow is smoothly turned from the air flow Fa to the air flow Fb. In this manner, the exhaust fan 63 not only exhausts air from the hollow portion 300 of the rotating drum 30 but also serves as an air flow turning fan which turns the air flow.

Moreover, in the printing apparatus 1, frame members 81, 82, and 83 are disposed so as to divide the print region Ra, the path region Rb, and the work region Rc. The frame members 81, 82, and 83 have substantially flat shapes extending in the X-direction and are arranged in the Y-direction in the order of 81, 82, and 83. The frame member 81 is disposed between a front portion of the housing member 10 on the front side in the Y-direction (+Y side) and the rotating drum 30, and includes four openings 811 aligned in the X-direction between the louver 11 and the hollow portion 300. The frame member 81 holds the blower fans 61 in each of the openings 811. The frame member 82 is disposed on the boundary of the print region Ra and the path region Rb, and includes four openings 821 which are aligned in the X-direction and oppose the hollow portion 300. The frame member 82 holds the exhaust fans 62 in each of the openings 821. Moreover, the frame member 82 divides the print region Ra and the path region Rb, and serves to block air flow between the region Ra and Rb in regions other than the hollow portion 300. The frame member 83 is disposed on the boundary of the path regions Rb and the work region Rc to divide the path region Rb and the work region Rc and serves to block air flow between the regions Rb and Rc.

In this regard, as mentioned above, the unit supporting member 35 is free to move in the Y-direction between the print location Ta in the print region Ra and the work location Tc in the work region Rc along with the print heads 36*a* to 36*e* and the UV irradiators 37*a* and 37*b*. In order to prevent interference with the unit supporting member 35 moving across the path region Rb in this manner, the frame members 82 and 83 are configured to extend to a level lower than the moving path of the functional portions 35, 36*e* to 36*e*, 37*a*, and 37*b*. However, in order to securely block the air flow between the regions Rb and Rc, the frame member 83 is configured to extend to a level higher than the exhaust fans 62 and 63. Specifically, the frame members 82 and 83 extend to a level of the virtual plane P30 in the areas opposing the rotating drum 30 in the Y-direction.

Figure 5:
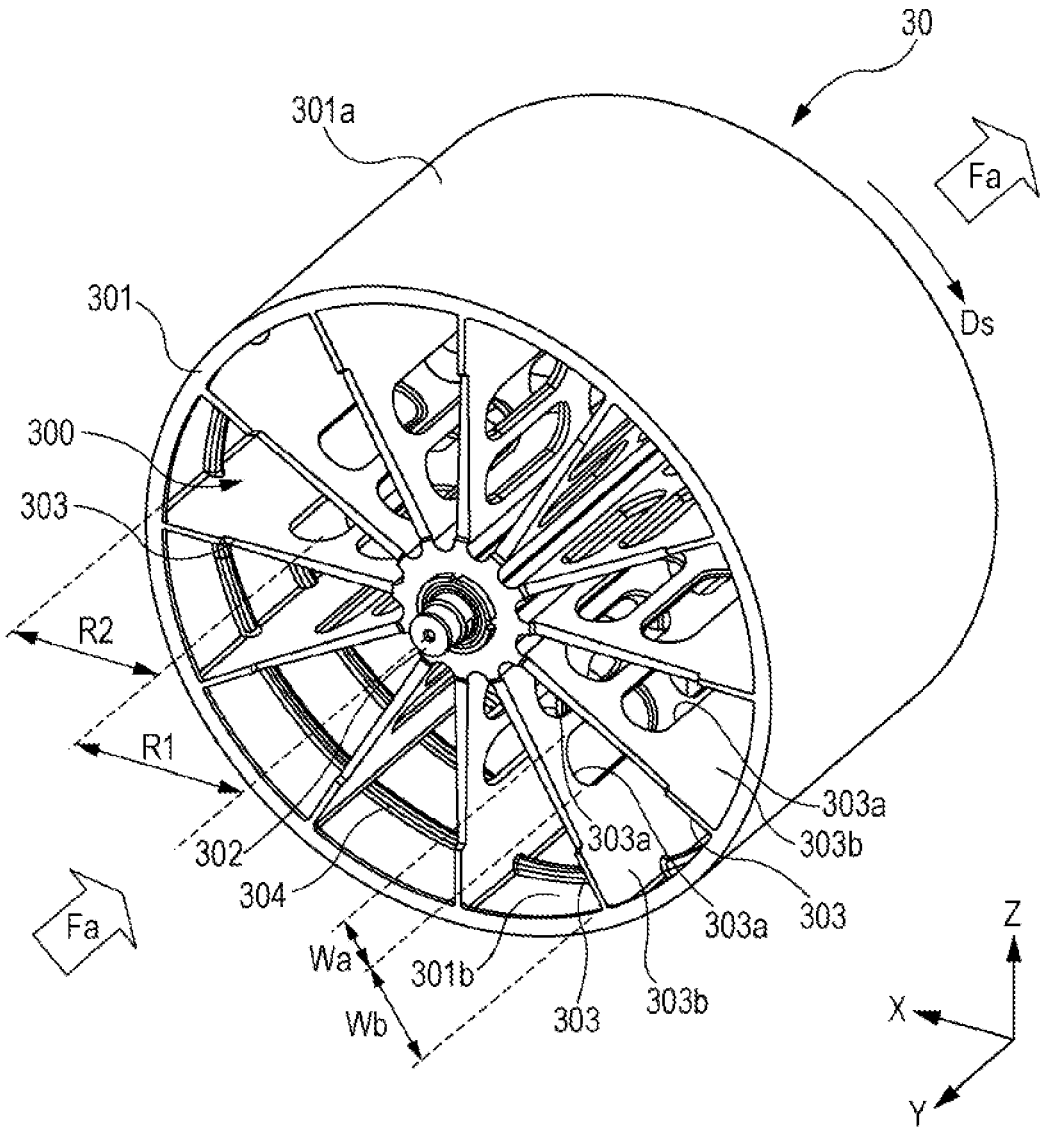
FIG. 5 is a front perspective view partially illustrating a configuration of a rotating drum.

The configuration of the air flow generating system 6 that generates the air flows Fa and Fb for cooling the rotating drum 30 has been described. Now, an example of the rotating drum 30 to be cooled down by the air flow generating system 6 will be described in detail. FIG. 5 is a front perspective view partially illustrating a configuration of the rotating drum. As mentioned above, the rotating drum 30 includes the hollow cylinder 301 (a rim) surrounding the hollow portion 300 penetrating therethrough in the axial direction Y and the rotation shaft 302 which is disposed in the hollow portion 300 and extends in the axial direction Y. Furthermore, as shown in FIG. 5, the rotating drum 30 includes, in the hollow portion 300, a plurality of arms 303 (ribs) that extend radially from the rotation shaft 302 in the radial direction and are arranged at constant angular intervals in the rotation direction Ds (the peripheral direction). The inner peripheral surface 301*b* of the hollow cylinder 301 is connected to the rotation shaft 302 via the plurality of arms 303. In this manner, the hollow cylinder 301 is supported by the plurality of arms 303.

Each of the arms 303 is configured to have a flat shape that tapers outwardly in the radial direction of the rotating drum 30 and has the same length as the hollow cylinder 301 in the axial direction Y. The arm 303 has the air holes 303*a*. Each of the air holes 303*a* is formed so as to be longer in the axial direction Y, to have a shape of a long hole having a width Wa in the radial direction, and to penetrate through the arm 303 in the rotation direction Ds. In each of the arms 303, the plurality of air holes 303*a* are disposed both in the axial direction Y and in the radial direction to be arranged in a two-dimensional array. Furthermore, a fin portion 303*b* that does not have the air holes 303*a* is disposed in an outer region of the arm 303. The fin portion 303*b* is disposed so as to extend from the inner peripheral surface 301*b* of the hollow cylinder 301 toward the rotation shaft 302 in the radial direction so as to have a width Wb which is larger than or equal to the width Wa of the air holes 303*a*. The fin portion 303*b* is disposed over the entire length of the hollow cylinder 301 in the axial direction Y.

From another viewpoint, the air holes 303*a* are disposed as follows, where the radius of the rotating drum 30 is r. That is, the total area of the air holes 303*a* disposed in a region R1 of the arms 303 which lies at a distance of r/2 or less from the center line of the rotating drum 30 in the radial direction is larger than the total area of the air holes 303*a* disposed in a region R2 of the arms 303 which lies at a distance larger than r/2 from the center line of the rotating drum 30. In this manner, the region of the arms 303 closer to the center of the rotating drum 30 has more air holes 303*a*.

Figure 6:
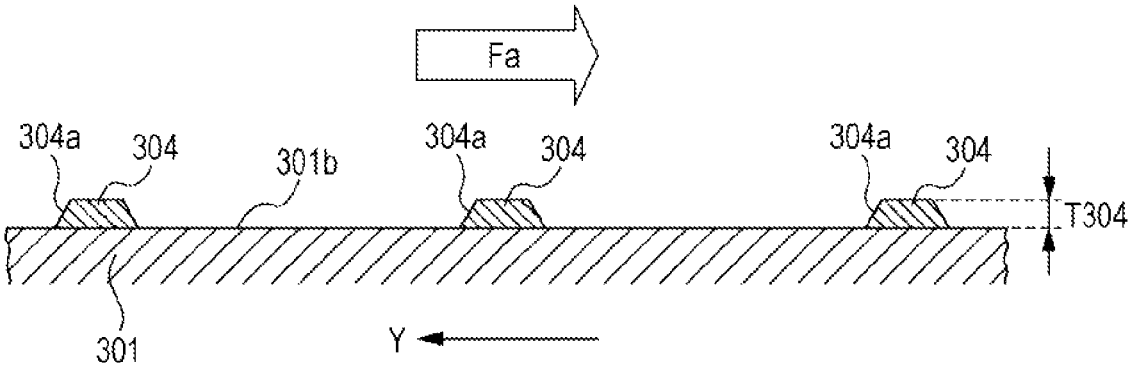
FIG. 6 is a Y-direction partial sectional view schematically illustrating a section of an auxiliary heat dissipation member.

Furthermore, the rotating drum 30 has at least one auxiliary heat dissipation member 304 formed on the inner peripheral surface 301*b* of the peripheral portion 301. The auxiliary heat dissipation member 304 has the shape of a ring that extends over the entire periphery in the rotation direction Ds (the peripheral direction) of the inner peripheral surface 301*b* of the hollow cylinder 301. The at least one auxiliary heat dissipation member 304 may include a plurality of auxiliary heat dissipation members 304 evenly spaced apart from each other in the axial direction Y and has a sectional shape shown in FIG. 6. FIG. 6 is a Y-direction partial sectional view schematically illustrating a section of the auxiliary heat dissipation member. As shown in FIG. 6, each of the plurality of auxiliary heat dissipation members 304 protrudes from the inner peripheral surface 301*b* of the hollow cylinder 301 so as to have an even thickness T304 from the inner peripheral surface 301*b*. Each of the auxiliary heat dissipation members 304 has a trapezoidal shape which tapers with increasing distance from the inner peripheral surface 301*b* in the radial direction in the section in the axial direction Y. That is, the auxiliary heat dissipation member 304 includes a wall surface 304*a* that is inclined in the direction of the air flow Fa and is disposed on an upstream side of the air flow Fa passing through the hollow portion 300. Moreover, the auxiliary heat dissipation member 304 also serves as a stiffening member for maintaining the shape of the hollow cylinder.

Then, the air flow Fa generated by the air flow generator 6 passes through the hollow portion 300 of the rotating drum 30 having the configuration shown in FIGS. 5 and 6. As a result, heat exchange is performed between the air flow Fa and the rotating drum 30, so that the rotating drum 30 is cooled down, whereby variation of the platen gap (the paper gap) can be suppressed. Thus, it is possible to stabilize the positions of the inks deposited on the sheet S to form an excellent image.

As described above, according to this embodiment, the rotating drum 30 includes the hollow cylinder 301 having the outer surface 301*a* around which the sheet S is guided. The print heads 36*a* to 36*e* can discharge inks onto the sheet S which is guided around the outer surface 301*a* of the rotating drum 30 to record an image on the sheet S. Moreover, The air flow generating system 6 that generates the air flow Fa passing through the hollow portion 300 of the rotating drum 30 (a portion surrounded by the hollow cylinder 301) is disposed so that the rotating drum 30 is cooled down by the air flow Fa.

However, the rotating drum 30 includes, in the hollow portion 300, the rotation shaft 302 that has an axis identical to the rotation axis of the rotating drum 30 extending in the axial direction Y and the arms 303 that extend from the rotation shaft 302 in the radial direction and support the hollow cylinder 301, and rotates about the rotation shaft 302 in the rotation direction Ds. Therefore, when the rotating drum 30 rotates, the arms 303 in the hollow portion 300 also rotate in the rotation direction Ds. In addition, the rotation direction Ds of the arms 303 is a direction intersecting (substantially orthogonal to) the direction of the air flow Fa passing through the hollow portion 303, whereby the rotating arms 303 may block the air flow Fa.

Therefore, according to this embodiment, the air holes 303*a* penetrating through corresponding arms 303 in the rotation direction Ds are provided. Therefore, the air flow Fa generated by the air flow generating system 6 passes through the air holes 303*a* in the rotation direction Ds, thereby avoiding being caught by the arms 303 rotating in the rotation direction Ds to be able to pass through the hollow portion 300. As a result, a large amount of high-speed air flow Fa is generated and introduced into the hollow portion 300 of the rotating drum 30, whereby the rotating drum 30 can be efficiently cooled.

As mentioned above, heating of the rotating drum 30 becomes a problem when the heat from the drum 30 thermally expands the rotating drum 30, which causes the gap between the rotating drum 30 and the print heads 36*a* to 36*e* to vary. In particular, expansion of the outer surface 301*a* of the rotating drum 30 considerably affects the gap between the rotating drum 30 and the print heads 36*a* to 36*e*. Therefore, it is important to efficiently cool the hollow cylinder 301 of the rotating drum 30 on which the outer surface 301*a* is formed. In this respect, the arms 303 in this embodiment include the fin portion 303*b* that does not have the air holes 303*a* and that has the width Wb from the inner peripheral surface 301*b* of the hollow cylinder 301 to the rotation shaft 302 in the radial direction. In such a configuration, while a large amount of high-speed air flow Fa is secured in the hollow portion 300 by the air holes 303*a* disposed in a region other than the fin portion 303*b*, the air flow Fa can sufficiently impinge on a portion of the arms 303 which is close to the hollow cylinder 301 (the fin portion 303*b*). As a result, the hollow cylinder 301 can exchange heat via the fin portion 303*b* with a large amount of the high-speed air flow Fa, whereby the hollow cylinder 301 can be efficiently cooled.

In particular, the width Wb of the fin portion 303*b* in the radial direction has a length larger than or equal to the width Wa of the air hole 303*a* in the radial direction. The fin portion 303*b* has the width Wb (≥Wa) in this manner, whereby the hollow cylinder 301 can be efficiently reliably cooled.

According to this embodiment, the total area of the air holes 303*a* disposed in a region of the arm 303 which lies at a distance of r/2 or less from the center line of the rotating drum 30 in the radial direction is larger than the total area of the air holes 303*a* disposed in a region of the arms 303 which lies at a distance larger than r/2 from the center line of the rotating drum 30 (where r is the radius of the rotating drum 30). In such a configuration, more air holes 303*a* are disposed in a region of the arms 303 which is close to the center of the rotating drum 30, whereby the air flow F does not pass through and is blown toward the region of the arms 303 which is close to the hollow cylinder 301. As a result, the hollow cylinder 301 can exchange heat with a large amount of the high-speed air flow Fa, whereby the hollow cylinder 301 can be efficiently cooled.

Furthermore, according to this embodiment, the plurality of air holes 303*a* are disposed in each of the arms 303 in the radial direction between the inner peripheral surface 301*b* of the hollow cylinder 301 and the rotation shaft 302. Also in the axial direction Y, the plurality of air holes 303*a* are disposed in each of the arms 303. Because the plurality of air holes 303*a* are disposed in each of the arms 303 in this manner, the arms 303 can effectively suppress blocking of the air flow Fa, so that a large amount of the high-speed air flow Fa can be generated into the hollow portion 300 of the rotating drum 30, whereby the cooling efficiency of the rotating drum 30 can be improved.

Moreover, according to this embodiment, the auxiliary heat dissipation member 304 is also disposed on the inner peripheral surface 301*b* of the hollow cylinder 301 in addition to the arms 303. In such a configuration, the air flow Fa can sufficiently impinge on the auxiliary heat dissipation member 304 disposed on the hollow cylinder 301, so that the hollow cylinder 301 can exchange heat via the auxiliary heat dissipation member 304 with a large amount of the high-speed air flow Fa, whereby the hollow cylinder 301 can be efficiently cooled.

In particular, according to this embodiment, the auxiliary heat dissipation member 304 is formed in the shape of a ring that extends over the entire periphery in the peripheral direction of the inner peripheral surface 301*b* of the hollow cylinder 301. The auxiliary heat dissipation member 304 is disposed in this manner to be able to promote heat exchange between the air flow Fa and the hollow cylinder 301 via the auxiliary heat dissipation member 304, whereby the hollow cylinder 301 can be efficiently reliably cooled.

In addition, the auxiliary heat dissipation member 304 includes the wall surface 304*a* that is inclined in the direction of the air flow Fa and is disposed upstream of the air flow Fa. In this manner, the wall surface 304*a* which the auxiliary heat dissipation member 304 includes upstream of the air flow Fa is inclined in the direction of the air flow Fa, whereby the blocking of the air flow Fa can be suppressed by the wall surface 304*a* of the auxiliary heat dissipation member 304.

Furthermore, the at least one auxiliary heat dissipation member 304 includes a plurality of auxiliary heat dissipation members 304 disposed in the axial direction Y. Each of the auxiliary heat dissipation members 304 has an even thickness T304 from the inner peripheral surface 301*b* of the hollow cylinder 301. In this manner, the plurality of auxiliary heat dissipation members 304 have the same thickness T304, whereby the blocking of the air flow Fa can be suppressed by the auxiliary heat dissipation member 304.

In this manner, in this embodiment, the printing apparatus 1 corresponds to an example of "an image recording apparatus" of the invention, the rotating drum 30 corresponds to an example of "a rotating drum" of the invention, the hollow portion 300 corresponds to an example of "a hollow portion" of the invention, the hollow cylinder 301 corresponds to an example of "an hollow cylinder" of the invention, the outer surface 301*a* corresponds to an example of "an outer surface" of the invention, the inner peripheral surface 301*b* corresponds to an example of "an inner peripheral surface" of the invention, the rotation shaft 302 corresponds to an example of "a shaft member" of the invention, the arms 303 correspond to an example of "supporting members" of the invention, the air holes 303*a* correspond to an example of "air holes" of the invention, the fin portion 303*b* corresponds to an example of "a fin portion" of the invention, the auxiliary heat dissipation member 304 corresponds to an example of "an auxiliary heat dissipation member" of the invention, the rotation direction Ds corresponds to an example of "a rotation direction" of the invention, the air flow generating system 6 corresponds to an example of "an air flow generator" of the invention, the air flow Fa corresponds to an example of "an air flow" of the invention, the print heads 36*a* to 36*e* correspond to an example of "discharge heads" of the invention, the UV lamps 37*a*, 37*b*, and 38 correspond to an example of "light irradiators" of the invention, the sheet S corresponds to an example of "a recording medium" of the invention, and the UV ink corresponds to an example of "a liquid" of the invention.

In this respect, the invention is not intended to be limited to the above embodiments, and various modifications may be made to the above-mentioned embodiments without departing from the scope of the invention. For example, in the above embodiments, the heat which expands the rotating drum 30 in the application of the invention has been described to be curing reaction heat of the UV ink. However, the heat source which expands the rotating drum 30 is not limited to the UV ink. Therefore, the invention is preferably applicable even if a driving source such as a motor or an actuator is the heat source. Consequently, the invention is applicable to the printing apparatus 1 without using a UV ink.

Moreover, the shape, the number, the arrangement, or the like of the arms 303 may be appropriately modified. Moreover, the shape, the number, the arrangement, or the like of the air holes 303*a* disposed on the arms 303 may be appropriately modified, and for example, the area which the air holes 303*a* occupy on the arms 303 is not limited to the above mentioned area.

Furthermore, the arrangement of the fin portion 303*b* disposed on the arms 303 may be appropriately modified. Therefore, it is not necessary to dispose the fin portion 303*b* over the entire length of the hollow cylinder 301 in the axial direction Y. The fin portion 303*b* may be disposed over the partial length of the hollow cylinder 301. Alternatively, the fin portion 303*b* may be omitted.

Moreover, the shape, the number, the arrangement, or the like of the auxiliary heat dissipation member 304 disposed on the rotating drum 30 may be appropriately modified. Alternatively, the auxiliary heat dissipation member 304 may be omitted.

Moreover, various modifications may be made to the air flow generating system 6. Therefore, the number, the arrangement, or the like of the blower fans 61 and the exhaust fans 62 and 63 also may be appropriately modified. Alternatively, the air flow generating system 6 may be constructed so as to generate the air flow Fa only by the blower fans 61 or only by the exhaust fans 62.

Furthermore, the number, the arrangement, or the like the print heads 36*a* to 36*e* and the UV lamps 37*a*, 37*b*, and 38 may be properly modified. Therefore, for example, the UV lamps 37*a*, 37*b*, and 38 are not necessarily disposed so as to oppose a portion of the sheet S that is guided on the rotating drum 30.

The entire disclosure of Japanese Patent Application No. 2013-054689, filed Mar. 18, 2013 is expressly incorporated by reference herein.

What is claimed is:

1. An image recording apparatus, comprising:

a rotating drum including a hollow cylinder around which a recording medium is guided while the rotating drum rotates;

a discharge head, opposing an outer surface of the rotating drum, that discharges liquid onto the recording medium guided around the outer surface of the rotating drum; and an air flow generator that generates an air flow that enters the hollow cylinder axially, passes through the inside of the hollow cylinder of the rotating drum, and exits the hollow cylinder axially;

wherein the rotating drum further includes, in the hollow cylinder, a shaft member that has an axis identical to a rotation axis of the rotating drum and supporting members that are plate-shaped and that extend from the shaft member in the radial direction of the rotating drum and support the hollow cylinder, and the rotating drum rotates in a rotation direction about the shaft member, wherein each of the supporting members includes at least one air hole penetrating therethrough in the rotation direction.

2. The image recording apparatus according to claim 1, wherein the total area of the at least one air hole disposed in a region of the supporting member which lies at a distance of r/2 or less from the rotation axis of the rotating drum in the radial direction is larger than the total area of the at least one air hole disposed in a region of the supporting member which lies at a distance larger than r/2 from the rotation axis of the rotating drum, where the radius of the rotating drum is r.

3. The image recording apparatus according to claim 1, wherein the supporting member includes a fin portion that does not have the at least one air hole and that has a width in the radial direction from the inner surface of the hollow cylinder toward the shaft member.

4. The image recording apparatus according to claim 3, wherein the width of the fin portion in the radial direction is equal to or larger than the width of the at least one air hole in the radial direction.

5. The image recording apparatus according to claim 1, wherein the at least one air hole includes a plurality of air holes in the radial direction between the inner surface of the hollow cylinder and the shaft member.

6. The image recording apparatus according to claim 1, wherein the at least one air hole includes a plurality of air holes in the axial direction.

7. The image recording apparatus according to claim 1, wherein the rotating drum further includes an auxiliary heat dissipation member on the inner surface of the hollow cylinder in addition to the supporting members.

8. The image recording apparatus according to claim 7, wherein the auxiliary heat dissipation member has the shape of a ring that extends over the entire periphery in the peripheral direction on the inner surface of the hollow cylinder.

9. The image recording apparatus according to claim 1, wherein the auxiliary heat dissipation member includes a wall surface that is inclined in the direction of the air flow and that is disposed on an upstream side in the direction of the air flow.

10. The image recording apparatus according to claim 1, wherein the discharge head further includes a light irradiator that irradiates a liquid having been discharged onto the recording medium with light, wherein the liquid is a photo-curable liquid which generates heat when it is cured by irradiation with light, wherein the light irradiator irradiates a portion of the recording medium that is guided around the rotating drum with light.

* * * * *